US006561222B1

(12) United States Patent
Gessner et al.

(10) Patent No.: US 6,561,222 B1
(45) Date of Patent: May 13, 2003

(54) CONTAINER FOR FLUIDS

(75) Inventors: Norbert Gessner, Friedrichsthal (DE); Reiner Schuster, Saarbrücken (DE); Jürgen Knoblauch, Völklingen (DE); Rainer Lodes, Zweibrücken (DE)

(73) Assignee: RAG Aktiengesellschaft, Essen (DE)

( * ) Notice: Subject to any disclaimer, the term of this patent is extended or adjusted under 35 U.S.C. 154(b) by 0 days.

(21) Appl. No.: 09/446,594

(22) PCT Filed: Jun. 23, 1998

(86) PCT No.: PCT/EP98/03828

§ 371 (c)(1),
(2), (4) Date: Mar. 29, 2000

(87) PCT Pub. No.: WO99/00321

PCT Pub. Date: Jan. 7, 1999

(Under 37 CFR 1.47)

(30) Foreign Application Priority Data

Jun. 27, 1997 (DE) ..... 197 27 294

(51) Int. Cl.[7] ..... B67D 5/02

(52) U.S. Cl. ..... 137/614.18; 137/590; 222/207; 222/212

(58) Field of Search ..... 137/614.18, 590; 222/94, 95, 207, 209, 212

(56) References Cited

U.S. PATENT DOCUMENTS

| | | | | | |
|---|---|---|---|---|---|
| 4,098,434 | A | * | 7/1978 | Uhlig | 222/94 |
| 4,193,417 | A | * | 3/1980 | Bowman et al. | 137/192 |
| 4,757,917 | A | | 7/1988 | Gleich et al. | |
| 4,817,830 | A | * | 4/1989 | Yavorsky | 222/386.5 |
| 5,435,468 | A | | 7/1995 | Clark, II | |
| 6,220,311 | B1 | * | 4/2001 | Litto | 141/67 |

FOREIGN PATENT DOCUMENTS

| | | |
|---|---|---|
| DE | 2316737 | 10/1974 |
| DE | 4230774 | 3/1994 |
| DE | 9319341 | 3/1994 |
| EP | 0276097 | 7/1988 |
| GB | 1270267 | 4/1972 |
| WO | 9637759 | 11/1996 |

* cited by examiner

*Primary Examiner*—Kevin Lee
(74) *Attorney, Agent, or Firm*—Friedrich Kueffner

(57) ABSTRACT

The invention relates to a container for fluids having a volume (2*a*) which can be filled with a fluid, and emptied by pressurizing the fluid by subjecting it to internal gas pressure. The invention is characterized in that the container has a valve device (7*a*) for filling the volume (2*a*) with the fluid, while the internal gas pressure is generated by compressing a gas trapped in the container (1*a*). It is thus not necessary to fill the receptacle with pressure gas separately.

17 Claims, 3 Drawing Sheets

CONTAINER FOR FLUIDS

BACKGROUND OF THE INVENTION

1. Field of the Invention

The invention is directed to a container or vessel for fluids with a vessel space which can be filled with a fluid and which can be emptied by applying pressure to the fluid via an internal gas pressure.

2. Description of the Related Art

Vessels of the type mentioned above for fluids, e.g., lubricants or adhesive components, which can be delivered or dispensed by compressed air and which are constructed as large-volume pressure vessels are known. After filling this vessel with the fluid, a valve is fitted and the vessel, which is not completely filled and in which a residual air volume remains, is put under pressure by air. The pressure and the residual air volume are so dimensioned that the vessel can be completely emptied via a rise tube connected with an outlet valve through the expansion of the enclosed air.

SUMMARY OF THE INVENTION

It is the object of the present invention to provide a novel vessel for fluids which is improved over the described known fluid vessels, especially with respect to the effort required for filling.

The vessel, according to the invention, by which this object is met is characterized by a valve arrangement for filling the vessel space with the fluid accompanied by the generation of the internal gas pressure through compression of a gas enclosed in the vessel.

As a result of this inventive solution, the vessel, after being filling, can be completely emptied immediately without additional steps by the internal gas pressure built up in the process of filling the vessel. Separate filling of the vessel with pressure gas is dispensed with.

In an embodiment form of the invention, the gas can be compressed in a pressure chamber which can be blocked off from the vessel space. In this case, the internal gas pressure required for emptying the fluid from the vessel space can advantageously remain limited to the pressure chamber which is substantially smaller compared to the total vessel volume. Accordingly, the stored fluid itself is not under pressure and the vessel does not come under the applicable legal regulations for authorization of transport vessels carrying fluid under pressure. Due to the fact that the pressure can remain limited to the small volume of the pressure vessel with a correspondingly small pressure volume product, the strength standards to be met by the vessel space are not as high as those for the vessels known from the prior art which are completely under pressure. The vessel weight can be advantageously reduced because of these less demanding requirements for strength.

In a preferred embodiment form of the invention, the valve arrangements are formed by a double valve unit which comprises a filling valve and/or outlet valve and which is provided for closing the filling valve and/or outlet valve while blocking off the pressure chamber from the vessel space, wherein the double valve unit preferably has a closing position in which the pressure chamber is already blocked off from the vessel space and the filling valve and/or outlet valve is still open. In a vessel constructed in this manner, pressure relief in the vessel space is advantageously carried out automatically after the blocking off of the pressure chamber before the vessel space is closed also. The desired pressureless state of the vessel space is achieved in an individual actuation process of the double valve unit in which first the pressure chamber and then the vessel space is blocked off.

The double valve unit is preferably to be actuated via a connection piece which can be connected with the filling valve and/or outlet valve, wherein an actuating rod projects into the opening of the filling valve and/or outlet valve for the actuation of the double valve unit, particularly from the connection piece. The sequential closing process mentioned above is effected automatically when the connection piece which is connected, e.g., with a line hose is uncoupled from the filling valve and/or outlet valve.

In a further advantageous construction of the invention, it is provided that the double valve unit comprises a pipe piece which extends through the pressure chamber and communicates at one end in a fluid connection with the vessel space, wherein the filling valve and/or outlet valve is arranged at its other end and its pipe wall has at least one valve opening which opens toward the pressure chamber and which can be blocked off by means of a part which is displaceable in the pipe piece by means of actuation of the filling valve and/or outlet valve. The at least one valve opening preferably opens into a conical annular groove of the pipe piece in which a resilient sealing ring which closes the valve opening relative to the pressure chamber in the manner of a spherical valve is arranged and is expandable by means of an actuation part projecting from the valve opening against the displaceable part and the sealing ring for releasing the valve opening. The displaceable part is preferably constructed as an inner pipe which is coaxial to the pipe piece and which has a pipe portion that can rest against the actuation part for releasing the valve opening and a pipe portion with an outer diameter which is reduced relative to the pipe portion. The actuation part is preferably formed by a pressure ball and a plurality of valve openings receiving pressure balls of this type are provided so as to be distributed about the circumference of the pipe piece, wherein the pressure balls are held in the valve openings between the sealing ring and the inner pipe. In an embodiment form of this kind, the valve openings are released as long as the pipe portion of the inner pipe resting against the actuation part ensures that the sealing ring cannot be pressed into its closed position in the annular groove by the internal pressure of the pressure vessel. When the vessel is closed via the filling valve and/or outlet valve, the inner pipe is displaced, so that the portion of the inner pipe with reduced diameter is located opposite the check valve opening and the actuation part can project into the interior space of the pipe piece while closing the valve openings.

In a preferred embodiment form in which the pressure vessel and the double valve unit are arranged at the upper side of the vessel, a delivery pipe or rise pipe projecting into the vessel space adjoins the inner pipe.

In another embodiment form which is advantageous with respect to manufacture as well as convenience of handling, the vessel space, pressure chamber and double valve unit are arranged coaxial to the longitudinal axis of the vessel.

In another preferred embodiment form of the invention, the vessel space is blocked off relative to the enclosed gas by a dividing wall which is movable for compressing the gas and for applying pressure to the fluid. While an internal pressure which is usable for expelling the fluid from the vessel can also immediately build up over the fluid level and expel the fluid from the vessel via the rise pipe, any contact between the fluid and the gas is advantageously prevented by a dividing wall of this kind, so that the fluid cannot be disadvantageously influenced by the gas. Further, no pressure gas can escape when emptying the vessel.

In a preferred embodiment form of the invention, the dividing wall is formed by a balloon which is expandable for the compression of the gas or for applying pressure to the fluid inside the vessel. The valve arrangement advantageously comprises a filling valve which opens toward the interior of the balloon, wherein the balloon is constructed in particular in such a way that it can be compressed by the internal gas pressure to virtually zero accompanied by reduction of the volume in the interior of the balloon. In this case, especially when the pressure of the enclosed gas in the empty state of the vessel space exceeds the air pressure acting on the vessel, a fluid contained in the balloon is expelled completely from the vessel while preventing residues.

In another advantageous construction of the invention, the filling valve and the balloon are constructed as a constructional assembly which can be mounted on the vessel, wherein the balloon is connected with the filling valve in such a way that it can be introduced into the vessel through a valve opening which is provided at the vessel and which, for example, is provided with a thread, wherein the filling valve provided with an external thread is then screwed into the thread of the opening.

The invention will be explained and described more fully with reference to an embodiment example and the accompanying drawings relating to this embodiment example.

DESCRIPTION OF THE PREFERRED EMBODIMENTS

Figure 1:
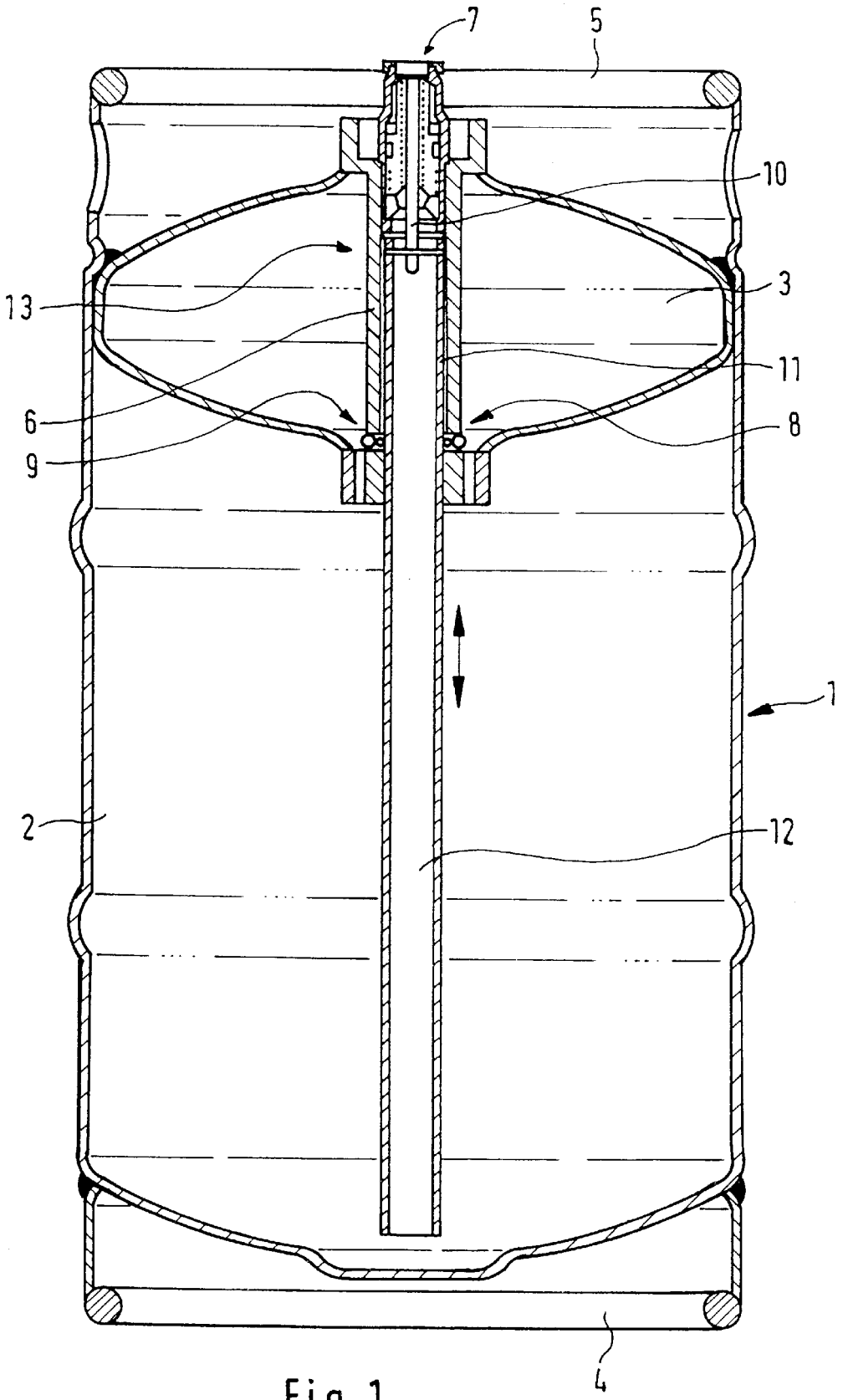
FIG. 1 shows a fluid vessel according to the invention in vertical section.

A substantially round-cylindrical vessel with rounded end faces, designated by reference number 1 in FIG. 1, is divided into a vessel space 2 and a pressure chamber 3. In the embodiment example shown, the volume of the vessel space is 25 l and the volume of the pressure chamber is 5 l. The cylindrical wall projects over the vessel end faces at both ends of the vessel 1, wherein a steel ring 4 and 5, respectively, is arranged at each end edge.

Below the ring 5, the projecting cylindrical wall has recesses, not shown, affording gripping possibilities for handling the vessel by grasping around the steel ring 5.

A double valve unit, designated by reference number 13 in FIG. 1, has a pipe piece 6 which is guided through the pressure chamber 3. A filling/outlet valve 7 is arranged at the end remote of the vessel space 2 in the pipe piece 6 opening toward the vessel space 2. The pipe piece 6 further has, in its pipe wall, valve openings 8 and 9 which open into the pressure chamber 3 and which are described more precisely with reference to FIGS. 2 and 3. An inner pipe 11 which is connected with the valve 7 via a pin 10 is arranged inside the pipe piece 6 and is displaceable against the pipe piece 6. The inner pipe 11 having portions with diameters of different size is connected with a rise pipe 12 which projects into the vessel space 2.

Figure 3:
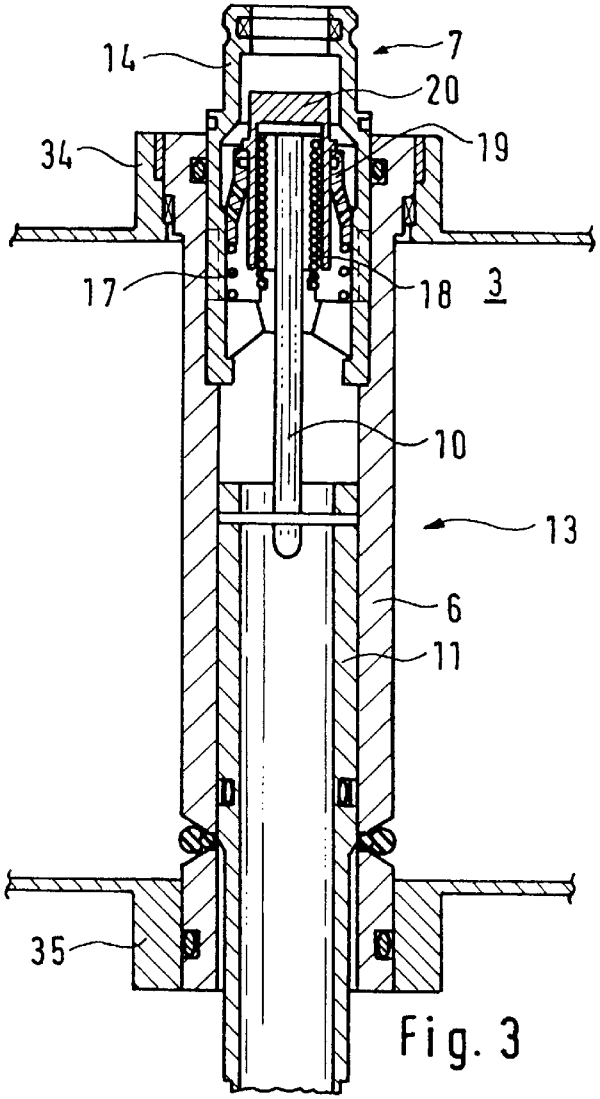
FIG. 3 shows the double valve from FIG. 2 in an opened position.
Figure 2:
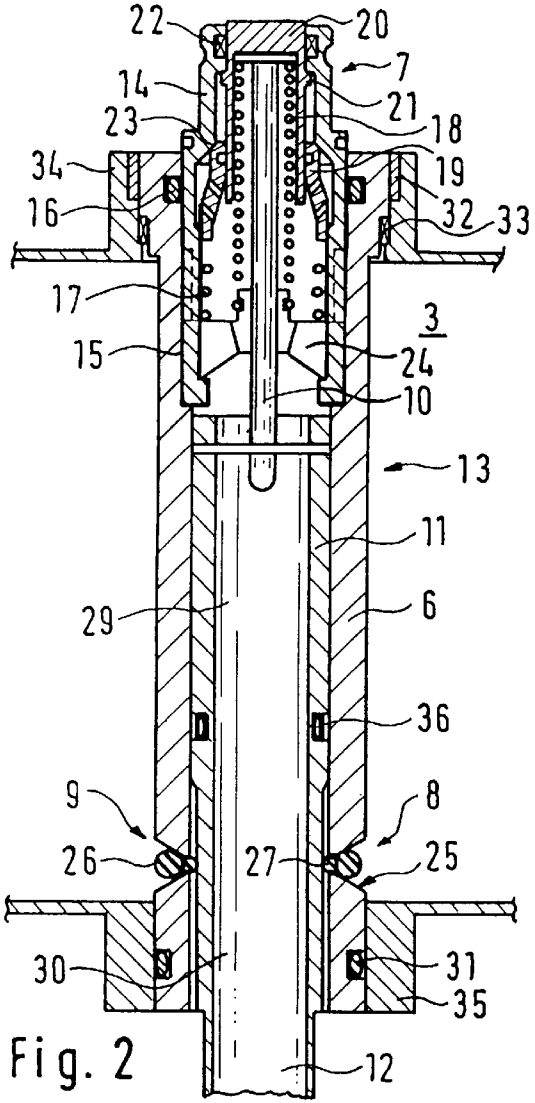
FIG. 2 shows a double valve used in the vessel shown in FIG. 1 in a closed position.

Reference is had now to FIGS. 2 and 3 in which the double valve unit 13 is described more exactly. Identical parts are designated in FIGS. 2 and 3 by the same reference numbers used in FIG. 1.

As will be seen from FIGS. 2 and 3, the filling/outlet valve 7 has a sleeve part 14 which is received in a seat or receptacle 15 formed in the pipe piece 6 by a widening of the inner diameter and is sealed relative to the pipe piece 6 by a ring seal 16. Valve parts 19 and 20 which are displaceable in the direction of the longitudinal axis coaxial to the longitudinal axis of the sleeve against helical springs 17 and 18 are arranged in the sleeve part 14. In the closed state shown in FIG. 2, the valve part 20 rests against the sleeve 14 by an annular projection 21 and is sealed relative to the seal 14 by a ring seal 22. In this state, the valve part 19 having through-openings rests against the sleeve part 14 by a sealing ring surface 23.

As will further be seen in FIGS. 2 and 3, the helical springs 17 and 18 rest against a support plate 24 arranged in the sleeve 14 by their ends remote of the valve part 19 and 20, respectively. The support plate 24 has a central guide opening for the pin 10 which is connected with the valve part 20 and the inner pipe 11.

A flexible seal ring, designated by reference number 26 in FIG. 3, is seated in a conical annular groove extending about the pipe piece 6 and closes the valve openings 8 and 9 opening toward the annular groove 25 in the manner of a ball valve. The valve openings 8 and 9 are representative of a plurality of valve openings of this type which are distributed about the circumference of the pipe piece 6. Pressure balls 27 which rest against the sealing ring 26 and project over the inner pipe 11 are arranged in the valve openings, wherein the pressure balls are held in the valve opening by the sealing ring 26 and the pipe piece 11.

As will be seen clearly with reference to FIGS. 2 and 3, the inner pipe 11 has portions 29 and 30 with different diameters, wherein the portion 29 with the greater diameter is formed in the pipe piece 6 and a transition portion 28 extending at an inclination to the longitudinal axis of the pipe is formed between the portions. The diameter of portion 30 is reduced relative to portion 29 to the extent that the rotating balls 27 can project into the interior of the pipe piece 6 until the sealing ring 26 rests circumferentially in the conical annular groove 25 and closes the valve openings.

In FIGS. 2 and 3, seal rings are designated by reference numbers 31 to 33, wherein a double valve unit 13 is sealed relative to the sleeve parts 34, 35 connected with the wall of the pressure chamber 3.

The inner pipe 11 is provided with a two-part seal ring 36 whose outer part having a strip cross section is made from a plastic-bronze mixture with good sliding properties.

The manner of operation of the fluid vessel described in FIGS. 1 to 3 will be described in the following.

In order to fill the vessel, a connection piece, not shown in the Figures, which is connected, e.g., with a hose line, is arranged at the sleeve part 14, and presses the valve part 20 into the sleeve part 14 into the position shown in FIG. 3 against the pressure of the helical spring 18 by means of a projecting rod. During this displacement, the annular projection 21 comes into contact against the valve part 19 which is likewise displaced against the force of the helical spring 17, wherein the sealing ring surface 23 is distanced from the wall of the sleeve part 14 while releasing the opening gap. Along with the displacement of the valve part 20, the inner pipe 11 is also displaced via pin 10 into the position shown in FIG. 3 in which the inner pipe 11 comes into contact against the pressure balls 27, first with the transition portion 28 and then with the widened portion 29, and expands the sealing ring 26, so as to prevent a closing of the valve openings by internal pressure of the pressure chamber 3 acting on the sealing ring 26.

In this open position of the double valve unit 13 shown in FIG. 3, the vessel is first placed under low gas pressure (e.g., 0.7 bar) via the connection piece (not shown) and the vessel is then filled with a fluid, e.g., a lubricant or a component of an adhesive, via this connection piece, wherein the fluid reaches the vessel 2 through the sleeve part 14, the pipe piece 6, the inner pipe 11 and the rise pipe 12 connected thereto.

As the level of fluid rises, the gas which is enclosed in the vessel and which can be suitably selected, e.g., corresponding to the type of fluid is compressed and reaches the pressure chamber 3 via the intermediate space formed between portion 30 of the inner pipe 11 and pipe piece 6 and via the valve openings (8 and 9), wherein the internal pressure increases as the liquid level rises.

When the vessel space 2 is filled, i.e., the liquid level reaches the pressure chamber 3, the filling/outlet valve 7 is automatically closed with the removal of the connection piece, not shown, in that the valve parts 19 and 20 are displaced into the position shown in FIG. 2 by the springs 17 and 18. Accordingly, a displacement of the inner pipe 11 is also carried out via the pin 10, wherein the portion 30 of the inner pipe 11 having the smaller diameter now makes it possible for the pressure balls 27 to project into the interior of the pipe piece 6 until the valve openings (8 and 9) are closed via the sealing ring 26 under the influence of the internal pressure in the pressure chamber 3.

Immediately after the closing of the valve openings 8 and 9 and before the closing position shown in FIG. 2 is reached, the filling/outlet valve 7 is not yet closed, so that gas under pressure remaining in the vessel space 2 can escape outward through the filling/outlet valve. When the filling/outlet valve 7 is then completely closed, the vessel space 2 is no longer under pressure. Only the substantially smaller pressure vessel 3 is still acted upon by pressure.

The vessel can now be loaded for transport, for example, wherein a steel ring 4 ensures that the vessel will stand securely on a loading base.

To empty the vessel at a desired location, a connection piece of a hose line is connected to the filling/outlet valve 7 in the same manner as when filling, wherein, as was already described above, the valve openings (8 and 9) are also opened in addition to the valve 7, so that the gas pressure present in the pressure chamber 3 contacts the surface of the liquid stored in the vessel via the valve openings 8 and 9 and the intermediate space between the inner pipe 11 and the pipe piece 6 and the liquid presses outward through the rise pipe 12, inner pipe 11, pipe piece 6 and valve 7.

The initial gas pressure or pre-pressure generated in the vessel before the vessel is filled is dimensioned in such a way that it is ensured that the liquid stored in the vessel space 2 will be removed in its entirety from the vessel.

Figure 4:
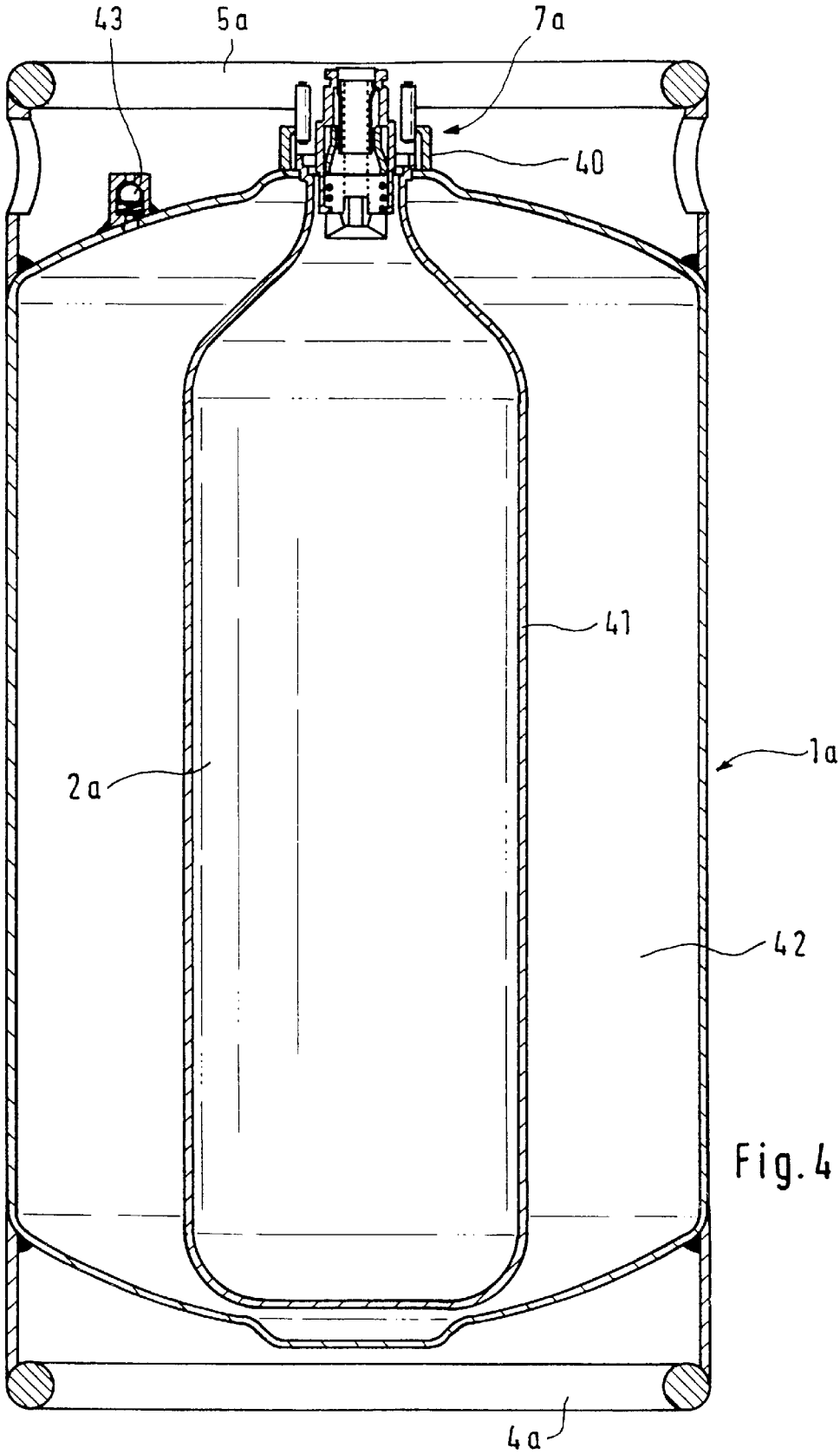
FIG. 4 shows another embodiment example for a fluid vessel according to the invention in vertical section.

Reference is had now to FIG. 4 which shows another embodiment example for a vessel according to the invention. Identical or identically working parts are designated by the same reference numbers as in the embodiment example shown above, but with the addition of the letter a. The relevant parts are therefore not described in more detail.

The embodiment example shown in FIG. 4 differs from the preceding embodiment example in that, instead of the double valve unit 13, only a filling/outlet valve 7*a* is provided which can be screwed into a threaded projection 40 at the valve opening of a vessel 1*a*.

The filling/outlet valve 7*a* is connected with a rubber balloon 41 arranged coaxial thereto, wherein the vessel interior is divided by the rubber balloon 41 into the vessel space portion 2*a* which is usable for filling with a fluid and a vessel space portion 42. The volume ratio between the vessel space portions 2*a* and 42 can be changed by means of the expandability of the rubber balloon 41.

A valve by means of which the vessel space 42 can be filled with a pressure gas is designated by 43 in FIG. 4.

In order to prepare the vessel shown in FIG. 4 for operation, a pressure gas, e.g., air, is introduced via the valve 43 with the balloon 41 completely emptied and the valve 7*a* open, wherein, in the embodiment example shown, a pressure greater than 0.7 bar is generated in the vessel. For this purpose, the balloon 41 is compressed, so that its internal volume is almost equal to zero.

The vessel which is provided with a pre-pressure, can now be filled with a liquid via the filling/outlet valve 7*a*, wherein the balloon 41 expands and the pressure gas in the vessel space portion 42 is compressed. In the embodiment example shown, the vessel which is produced from a resilient rubber material expands until the liquid filling pressure is equal to the gas pressure generated in the reduced vessel space portion 42. In the embodiment example shown, this liquid filling pressure is approximately 7 bar. The volume of the vessel space portion 42 was reduced in a corresponding manner to one tenth of the volume in a completely compressed balloon 41 and the majority of the vessel volume is now consequently filled with liquid.

The tightness of the vessel 1*a* is sufficiently high so that the liquid, e.g., for purposes of transport or storage, can remain in the vessel for a long period of time without pressure loss.

In order to empty the vessel, a connection piece is arranged at the filling/outlet valve 7*a*, which connection piece opens the latter when connected. The balloon 41 is now compressed by the internal gas pressure while the vessel 1*a* is emptied, wherein it is ensured by means of the suitably selected pre-pressure that the vessel volume 2*a* is brought approximately to the value of zero accompanied by an almost complete expulsion of the fluid from the vessel.

The liquid stored in the vessel does not come into contact with the surrounding atmosphere either during the filling process or during the emptying process, so that liquids stored and transported in the vessel cannot be impaired in any way.

The balloon 41 connected with the valve 7*a* can be removed from, i.e., pulled out of, the vessel together with the valve 7*a* when it is necessary to exchange or clean the balloon 41, for example, after a determined operating period or when the liquid to be stored in the vessel is changed.

What is claimed is:

1. Vessel for fluids with a vessel space (2, 2*a*) which can be filled with a fluid and which can be emptied by applying pressure to the fluid via an internal gas pressure, the vessel comprising a valve arrangement (13, 13*a*; 7*a*) for filling the vessel space (2, 2*a*) with the fluid accompanied by the generation of the internal gas pressure required for emptying the vessel through displacement and thereby compression of a gas enclosed in the vessel (1, 1*a*), wherein the gas can be compressed in a pressure chamber (3) which can be blocked off from the vessel space (2), and wherein the pressure chamber is not expandable so that it can hold the pressure when the fluid is discharged.

2. Vessel according to claim 1, wherein the valve arrangement is formed by a double valve unit (13) which comprises a filling valve and/or outlet valve (7) and which is provided for closing the filling valve and/or outlet valve while blocking off the pressure chamber (13).

3. Vessel according to claim 2, wherein the double valve unit (13) has a closing position in which the pressure chamber (3) is already blocked off from the vessel space (2) and the filling valve and/or outlet valve (7) is still opened.

4. Vessel according to claim 2, wherein the double valve unit (13) is to be actuated via a connection piece which can be connected with the filling valve and/or outlet valve (7).

5. Vessel according to claim 4, wherein the double valve unit (13) is to be actuated via a rod which projects from the connection piece and which can be inserted into the opening of the filling valve and/or outlet valve (7).

6. Vessel according to claim 2, wherein the double valve unit (13) comprises a pipe piece (6) which extends through the pressure chamber (3) and communicates at one end in a fluid connection with the vessel space (2), wherein the filling valve and/or outlet valve (7) is arranged at its other end and its pipe wall has at least one valve opening (8, 9) which opens toward the pressure chamber (3) and which can be blocked off by means of a part (11) which is displaceable in the pipe piece (6) by means of actuation of the filling valve and/or outlet valve (7).

7. Vessel according to claim 6, wherein the valve opening (8, 9) opens into a conical annular groove (25) of the pipe piece (6) in which a resilient sealing ring (26) which closes the valve opening (8, 9) relative to the pressure chamber in the manner of a spherical valve is arranged and is expandable by means of an actuation part (27) projecting from the valve opening against the displaceable part (11) and the sealing ring (26) for releasing the valve opening (8, 9).

8. Vessel according to claim 7, wherein the actuation part is formed as a pressure ball (27) and a plurality of valve openings are provided so as to be distributed about the circumference of the pipe piece (6).

9. Vessel according to claim 7, wherein the displaceable part is constructed as an inner pipe (11) which is coaxial to the pipe piece (6) and which has a pipe portion (29) that can rest against the actuation part (27) for releasing the valve openings and a pipe portion (30) with an outer diameter which is reduced relative to the pipe portion (29).

10. Vessel according to claim 7, wherein an intermediate portion (28) which is inclined relative to the longitudinal axis of the pipe is provided between the pipe portions (29, 30).

11. Vessel according to claim 10, wherein a delivery pipe (12) projecting into the vessel space (2) adjoins the inner pipe (11).

12. Vessel according to claim 2, wherein the vessel space (2), the pressure space (3) and the double valve unit (13) are arranged coaxial to a vessel longitudinal axis.

13. Vessel according to claim 1, wherein the vessel space (**2*a*) is separated from the enclosed gas by a dividing wall (41**) which is movable for compressing the gas and for applying pressure to the fluid.

14. Vessel for fluids with a vessel space which can be filled with a fluid and which can be emptied by applying pressure to the fluid via an internal gas pressure, the vessel comprising a valve arrangement for filling the vessel space with the fluid accompanied by the generation of the internal gas pressure required for emptying the vessel through displacement and thereby compression of a gas enclosed in the vessel, wherein the vessel space is separated from the enclosed gas by a balloon which is expandable for the compression of the gas, and wherein the valve arrangement comprises a filling/outlet valve arranged in an upper portion of the vessel, further comprising a connection piece configured to be placed on and removed from the filling/outlet valve for opening and closing the filling/outlet valve.

15. Vessel according to claim 14, wherein the balloon can be compressed by producing a gas pressure greater than 0.7 bar in the vessel space to virtually zero accompanied by reduction of the volume in the interior of the balloon.

16. Vessel according to claim 14, wherein the filling/outlet valve (**7*a*) and the balloon (41) from a constructional assembly which can be mounted jointly on the vessel (1*a***).

17. Vessel according to claim 14, wherein the pressure of the enclosed gas exceeds the surrounding air pressure action on the vessel in the empty state of the vessel space (**2, 2*a***).

* * * * *